US010012060B2

(12) United States Patent
De Simoni et al.

(10) Patent No.: US 10,012,060 B2
(45) **Date of Patent: *Jul. 3, 2018**

(54) RADIO FREQUENCY (RF) SYSTEM FOR THE RECOVERY OF HYDROCARBONS

(71) Applicant: ENI S.P.A., Rome (IT)

(72) Inventors: Michela De Simoni, San Donato Milanese (IT); Gilberto Toffolo, San Quirino (IT); Alessandro Cerutti, Cascina (IT)

(73) Assignee: Eni S.P.A., Rome (IT)

( * ) Notice: Subject to any disclaimer, the term of this patent is extended or adjusted under 35 U.S.C. 154(b) by 0 days.

This patent is subject to a terminal disclaimer.

(21) Appl. No.: 15/502,923

(22) PCT Filed: Aug. 10, 2015

(86) PCT No.: PCT/IB2015/056066

§ 371 (c)(1),
(2) Date: Feb. 9, 2017

(87) PCT Pub. No.: WO2016/024197

PCT Pub. Date: Feb. 18, 2016

(65) Prior Publication Data

US 2017/0226835 A1 Aug. 10, 2017

(30) Foreign Application Priority Data

Aug. 11, 2014 (IT) ..... MI14A1485

(51) Int. Cl.
*E21B 43/24* (2006.01)

(52) U.S. Cl.
CPC ..... *E21B 43/2401* (2013.01)

(58) Field of Classification Search
CPC ..... E21B 43/2401; E21B 36/04
USPC ..... 166/302, 248
See application file for complete search history.

(56) References Cited

U.S. PATENT DOCUMENTS

| | | | |
|---|---|---|---|
| 4,373,581 | A | 2/1983 | Toellner |
| 4,485,869 | A | 12/1984 | Sresty et al. |
| 4,508,168 | A | 4/1985 | Heeren |
| 7,441,597 | B2 | 10/2008 | Kasevich |
| 7,891,421 | B2 | 2/2011 | Kasevich |
| 8,371,371 | B2 | 2/2013 | Diehl et al. |
| 8,453,739 | B2 | 6/2013 | Parsche |
| 8,646,527 | B2 | 2/2014 | Trautman et al. |

(Continued)

FOREIGN PATENT DOCUMENTS

| | | |
|---|---|---|
| WO | 2009027305 A2 | 3/2009 |
| WO | 2009043055 A2 | 4/2009 |

(Continued)

OTHER PUBLICATIONS

International Search Report for PCT/IB2015/056066 dated Mar. 16, 2016, 11 pgs.

(Continued)

*Primary Examiner* — Silvana C Runyan
(74) *Attorney, Agent, or Firm* — Abel Law Group, LLP

(57) ABSTRACT

The present invention relates to a system for facilitating the extraction of hydrocarbons, in particular extraction by RF heating of high-viscosity hydrocarbons in situ by means of an antenna comprising a coaxial array of mode converters.

20 Claims, 5 Drawing Sheets

(56) References Cited

U.S. PATENT DOCUMENTS

| | | | | |
|---|---|---|---|---|
| 8,766,146 | B2 | 7/2014 | Diehl | |
| 9,115,576 | B2 * | 8/2015 | Dittmer | E21B 43/2401 |
| 9,482,080 | B2 * | 11/2016 | Wright | E21B 43/2401 |
| 2010/0219107 | A1 | 9/2010 | Parsche | |
| 2012/0061080 | A1 | 3/2012 | Sultenfuss et al. | |
| 2012/0061380 | A1 | 3/2012 | Parsche | |
| 2012/0061383 | A1 | 3/2012 | Parsche | |
| 2012/0090844 | A1 | 4/2012 | Madison et al. | |
| 2013/0284430 | A1 | 10/2013 | Parsche | |
| 2013/0334205 | A1 | 12/2013 | Wright et al. | |
| 2014/0216714 | A1 | 8/2014 | Dittmer et al. | |
| 2014/0216724 | A1 | 8/2014 | Dittmer | |
| 2014/0301017 | A1 | 10/2014 | Diehl et al. | |
| 2015/0279571 | A1 | 10/2015 | Diehl | |
| 2017/0237145 | A1 * | 8/2017 | Di Renzo | H01Q 1/04 166/60 |

FOREIGN PATENT DOCUMENTS

| | | | |
|---|---|---|---|
| WO | 2009109489 | A1 | 9/2009 |
| WO | 2012067769 | A2 | 5/2012 |
| WO | 2013060610 | A1 | 5/2013 |
| WO | 2014048593 | A2 | 4/2014 |
| WO | 2016024197 | A2 | 2/2016 |
| WO | 2016024198 | A2 | 2/2016 |

OTHER PUBLICATIONS

Matteo Bientinesi et al., 'A radio frequency/microwave heating method for thermal heavy oil recovery based on a novel tight-shell conceptual design,' Journal of Petrolleum Science and Engineering 107 (2013) pp. 18-30, Italy.

International Search Report for PCT/IB2015/056067 dated Apr. 15, 2016, 13 pgs.

* cited by examiner

RADIO FREQUENCY (RF) SYSTEM FOR THE RECOVERY OF HYDROCARBONS

The present invention relates to a system for facilitating the extraction of hydrocarbons, in particular extraction by RF heating of high-viscosity hydrocarbons in situ by means of an antenna comprising a coaxial array of mode converters.

DESCRIPTION

Field of the Invention

The present invention relates to a system for facilitating the extraction of hydrocarbons, in particular extraction by RF heating of high-viscosity hydrocarbons in situ by means of an antenna comprising a coaxial array of mode converters.

Prior Art

Numerous methods and systems are known from the prior art for the extraction of hydrocarbons by means of heating the hydrocarbons themselves.

In particular, patent applications or already published patents disclose methods and systems for the application of RF heat within oil wells. These documents generally describe apparatus comprising generators of RF energy installed at the surface, transmission lines for transporting the RF signal to the base of the well and constructions (antennas) for irradiating or applying RF energy to the geological formation.

Some patent reference documents describe possible methods for oil production which can be achieved by means of RF heating in situ, in particular:

Reducing the viscosity of heavy oils (U.S. Pat. No. 7,891,421 *Method and apparatus for in-situ RF heating* Kasevich (2011))

Liquefaction of solid hydrocarbons in reservoir conditions (tar sands) US 2012/0090844 *Simultaneous Conversion and recovery of bitumen using RF* Madison et al. 2012))

Production of oil by high-temperature pyrolysis of kerogens (in oil shale) (U.S. Pat. No. 4,485,869 *Recovery of liquid hydrocarbons from oil shale by electromagnetic heating in situ* Sresty et al. (1984))

Production of organic products from oil shale (U.S. Pat. No. 4,508,168 *RF applicator for in situ heating* Heeren (1985))

In-situ conversion (upgrading) by means of heating heavy oils to high temperature (with or without the introduction of materials, catalytic beds and/or other reactive substances) (US 2010/0219107 *Radio Frequency Heating of petroleum ore by particle susceptors* Parsche (2010); U.S. Pat. No. 7,441,597 *Method and apparatus for in-situ RF assisted gravity drainage of oil* Kasevich (2008))

Methods for injecting steam assisted by RF heating (US 2012/0061080 *Inline RF heating for SAGD operations* Sultenfuss et al. (2012); U.S. Pat. No. 8,646,527 *RF enhanced SAGD method for recovery of hydrocarbons* Trautman et al. (2014))

Further, there are patent reference documents relating to different types of antennas or applicators for wells:

Antennas, whether dipole, helical, solenoid or collinear (U.S. Pat. No. 7,441,597 *Method and apparatus for in-situ RF assisted gravity drainage of oil* Kasevich (2008); US 2012/0061380 *Apparatus and method for heating of hydrocarbon deposits by RF driven coaxial sleeve* Parsche (2012));

Electrode arrays (U.S. Pat. No. 4,485,869 *Recovery of liquid hydrocarbons from oil shale by electromagnetic heating in situ* Sresty et al. (1984));

Two-wire transmission lines folded back on themselves to form elongated loops (US 2012/0061383 *Litz Heating Antenna* Parsche (2012));

Triaxial transmission lines and sleeves (U.S. Pat. No. 8,453,739 *Triaxial linear induction antenna array for increased heavy oil recovery* Parsche (2013); US 2013/0334205 *Subterranean antenna including antenna element and coaxial line therein and related methods* Wright et al. (2013)).

Some of these references (U.S. Pat. No. 7,441,597; US 2012/0061380) describe wire antennas of the resonant type. These types of antenna are generally limited to a length of a few meters and allow a limited portion of the reservoir around the antenna to be heated to high temperature. Systems having antennas of this kind could provide effective solutions for oil sands. Antennas of this kind are obtained by installing within the well ad-hoc metal constructions, or in some cases making use of the completion elements themselves. Other systems (as described for example in U.S. Pat. No. 4,485,869) are based on arrays of electrodes installed in holes in the ground for forming a condenser construction. In these systems, heating is achieved inside the volume of the ground delimited by the electrodes. These systems have been proposed for the recovery of hydrocarbons in oil shale outcrops.

Finally, other systems proposed for application to oil sands are based on triaxial or elongated loop constructions for installations inside horizontal wells (US 2013/0334205, U.S. Pat. No. 8,453,739, US 2012/0061383). These antenna systems, which are supplied at relatively low frequency (in the range of 1-10 kHz) and power in the order of several MW, are proposed for heating that is distributed along a horizontal well to the high temperatures required for liquefaction of solid bitumen.

The systems of the prior art have limitations and practical disadvantages, as summarised below.

The resonant antennas of the concentrated type are not effective with horizontal wells having very long drains (for example having a length in the order of hundreds of meters). This is because resonant antennas cannot be effective in distributing radiation along the well, even if they have lengths typical of the drains concerned. For example, a dipole 1000 m long which is supplied from the centre and which irradiates within a dispersive medium (a typical range for the electrical conductivity of oil reservoirs is between 0.001 and 0.1 S/m) distributes an electrical field that is limited to a few meters around the supply point, regardless of the physical length of the dipole.

This performance is also characteristic of other types of resonant antenna, having geometric structures different from those of a dipole, such as helical, solenoid, or collinear with a coaxial sleeve dipole. Thus, it is not possible to utilise this class of antenna to distribute energy along the drain.

Distributed antennas, which are designed to work at frequencies of 1-10 kHz, have other disadvantages, however. The parameters of triaxial antennas do not allow the configuration or design of the radiating array to be a function of the characteristics of the surrounding medium or of the desired distribution of energy along the drain. In particular, the way RF power may be distributed uniformly along the drain is not defined. Furthermore, triaxial antennas may be very bulky constructions, given the need for sleeve constructions surrounding the transmission line. This last aspect may constitute a disadvantage for incorporating antennas into oil wells.

Two-wire line antennas folded back on themselves to form elongated loops have other disadvantages, however. The first of these arises from the fact that the two-wire line has high losses when transporting energy. This could result in a marked loss of energy inside the oil well, which is disadvantageous for the transfer of energy deep within the reservoir. Furthermore, and similarly to triaxial antennas, it is not clear how the distribution of power transferred to the medium may be controlled. It seems that the only parameter determining the radiant properties of the construction is the distance between the two conductors of the two-wire line, which is in any case limited to the section inside the well in which it is installed.

The proposed antennas having frequencies of 1-10 kHz have other disadvantages. Antennas of this kind operate in frequency ranges in which the distribution of electromagnetic energy in the radial direction (relative to the axis of the well) cannot be controlled by controlling the frequency. This is because in the range of 1-10 kHz, the skin depth (the depth at which the emf penetrates the medium, equal to d=sqrt(2/(swp)), where s is electrical conductivity, w is the angular frequency of the emf, and p is magnetic permeability) is much greater than the heating ray concerned (which could generally be in the order of 10-15 m). As s=0.01 S/m, the skin depth will in fact be in the order of 50-160 m for frequencies of between 10 and 1 kHz.

It follows that the heating range coincides with close range (r<<d), in which the distribution of the emf in the radial direction does not depend on frequency.

At higher frequencies, however, skin depth values are comparable with the heating ray (for example a skin depth of 1.5-5 m at frequencies of 10-1 MHz). This may be utilised to the benefit of thermal recovery, since it allows the distribution of energy deep in the medium (in the radial direction) to be regulated by the selection of frequency, which may thus be utilised to regulate the temperature range in the radial direction. Regulation of the temperature range may be utilised to maximise the mobility of the oil in the rock and to increase the well's productivity.

OBJECT OF THE PRESENT INVENTION

The object of the present patent application is to provide a technology that overcomes, at least in part, the disadvantages of the systems that are currently available.

GENERAL STATEMENT OF THE INVENTION

The present invention relates to a system for heating high-viscosity hydrocarbons in a reservoir, including a drain with hydraulic connection, the system including: a radio frequency generator suitable for generating an electromagnetic signal; a coaxial transmission line connected to the generator and suitable for transmitting the signal along the well, the coaxial line including an external conductor and an internal conductor which are separated by a layer of dielectric material; at least one mode converter which is positioned along the coaxial transmission line, in which the at least one mode converter interrupts the coaxial transmission line within the drain and includes a first and a second conductor, the first conductor of the converter providing an electrical connection between the external conductor of the transmission line upstream of the converter and the external conductor of the transmission line downstream of the converter, and the second conductor of the converter providing an electrical connection between the internal conductor of the transmission line upstream of the converter and the internal conductor of the transmission line downstream of the converter; the at least one mode converter being suitable for providing, in the presence of an RF signal along the coaxial transmission line, a disturbance of the differential mode of propagation of the signal along the coaxial transmission line and inducing a current in the external conductor of the coaxial transmission line and an electromagnetic field in the surrounding area which causes the hydrocarbons inside the reservoir to heat up.

According to a preferred embodiment of the present invention, the system includes a plurality of mode converters distributed along the coaxial transmission line inside the drain. In a preferred embodiment, the plurality of mode converters includes an array of mode converters placed at regular intervals along the coaxial transmission line. Each mode converter, by means of disturbance of the differential propagation mode, irradiates a proportion of the RF power that is propagated along the coaxial line, creating an irradiation that is distributed along the array of mode converters.

The mode converters may be of the capacitive or inductive type or indeed a combination of the two. Inductive converters cause a disturbance of the differential mode of propagation of the signal along the coaxial transmission line by means of at least one inductive element. Capacitive converters cause a disturbance of the differential mode of propagation of the signal along the coaxial transmission line by means of at least one capacitive element.

The system according to the present invention allows the RF irradiation to be distributed over long lengths of drain in horizontal, vertical or slant oil wells.

A system of this kind allows an effective increase in the productivity of wells for the recovery of high-viscosity hydrocarbons, in particular heavy oils, as a result of the ability to heat the reservoir uniformly and to moderate temperature over the entire length of the drain.

The importance of high-viscosity hydrocarbons as an energy resource is growing continuously as a result of the development of advanced methods of recovering oil, such as thermal recovery.

Heating the reservoir using RF energy by means of an antenna system located in a bore hole may be a valid alternative to traditional steam injection methods, in that it does not need to consume large quantities of water and may provide advantages such as the controlled distribution of energy, less dependence on the properties of the reservoir (in particular, the performance of steam injection methods depends to a large extent on the permeability of the reservoir and the continuity of the caprock), compact equipment, a limited expenditure of energy per barrel of oil produced as a result of the possibility of achieving a high level of efficiency in transporting energy to the base of the well and the possibility of controlling the distribution of energy inside the reservoir.

Radio frequency (RF) heating may thus be a valid alternative to steam injection for the thermal recovery of heavy oil, and may also be utilised to achieve moderate heating (in the order of just a few tens of degrees in a reservoir portion around the well in question) in cases where such heating is effective in reducing the viscosity of the oil to a significant extent and in increasing the productivity of the well.

BRIEF DESCRIPTION OF THE DRAWINGS

Reference will now be made to a series of drawings to facilitate the description of some preferred embodiments of the present invention.

DETAILED DESCRIPTION OF A PREFERRED EMBODIMENT

In a preferred embodiment of the present invention, the system operates by applying power in the order of 100-1000 kW at frequencies in the range of 0.1-10 MHz. An embodiment of the invention of this kind may be advantageous in achieving moderate heating along a drain in the order of several hundred meters in length, such as 1000 m or more. An embodiment of this kind may increase the productivity of a heavy oil well to a significant extent, at the same time ensuring a limited expenditure of energy per barrel of oil produced. In an embodiment of this kind, the increase in temperature may be 50° C. at the well, 28° C. five meters away from the well in the radial direction, 13° C. ten meters away and 10° C. fifteen meters away.

In a further preferred embodiment of the present invention, the system operating at frequencies of between 0.1 and 10 MHz is used for the recovery of heavy oils.

The system to which the present invention relates may be suitable, by way of the design of the array parameters, for different reservoirs and for achieving the desired distribution of RF radiation along the well.

Furthermore, the system to which the present invention relates allows RF lines of limited section to be obtained, which is an advantageous aspect when installing the antenna directly in producing wells of standard dimensions without the need for additional, dedicated wells.

The system to which the present invention relates is thus characterised by the ability to irradiate along the drain at the frequencies concerned in controlled manner.

Particularly advantageous is the configuration in which irradiation is uniform, or rather the power irradiated from each mode converter is constant along the drain.

Figure 1:
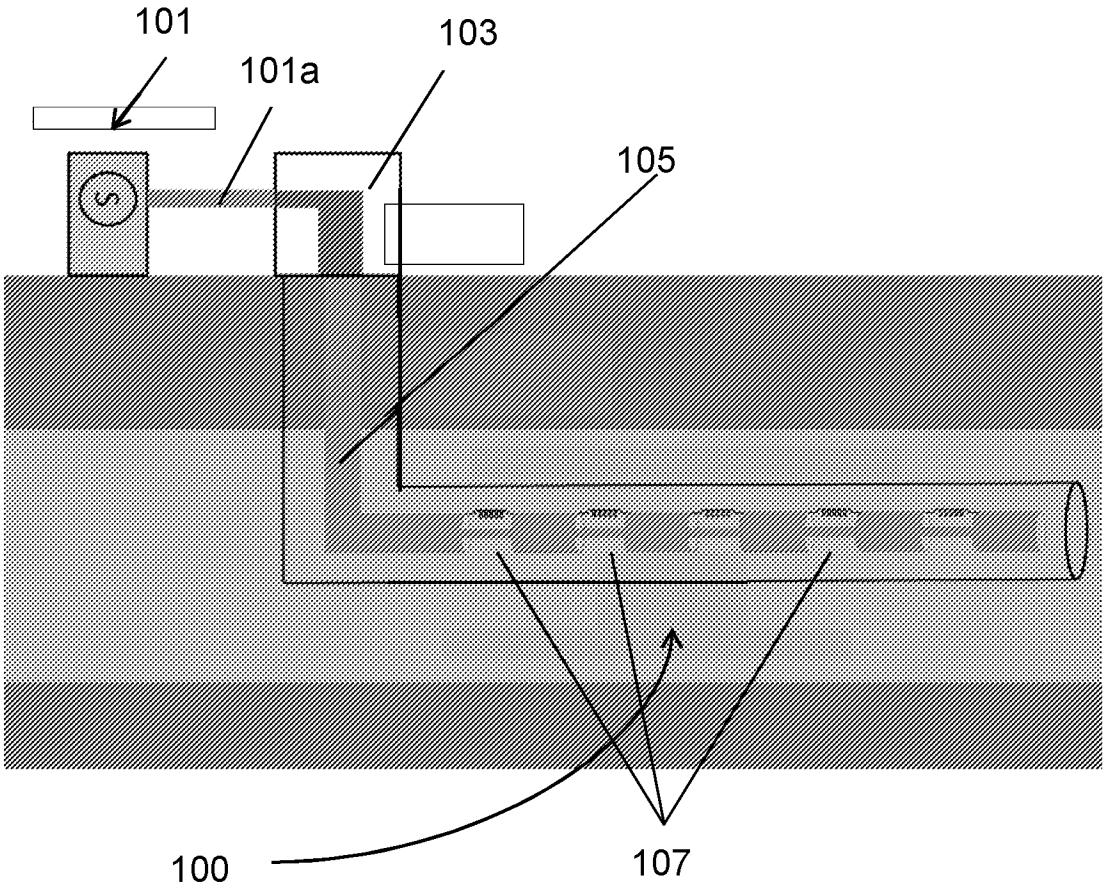
FIG. 1 shows a system for heating high-viscosity hydrocarbons in a drain according to a preferred embodiment of the present invention.

According to a preferred embodiment of the present invention, the system as illustrated in FIG. 1 includes an RF generator 101, a well perforator 103, a coaxial cable 105 and the coaxial array of mode converters 107 that form an antenna system 100.

The RF generator 101 is advantageously installed on the surface and operates within the range of frequencies of 0.1-10 MHz. In some embodiments, the generator 101 may deliver power <=1 MW to achieve moderate heating, if this is sufficient to reduce the viscosity of the heavy oils to a significant extent. In other embodiments, the power may be >=1 MW, if there is a requirement to reach high temperatures over a distance of several meters from the well in order to mobilise the hydrocarbon.

There are various ways to construct a high-power RF generator 101 in the range of frequencies concerned. The transmitter may take the form of an array of solid state amplifiers, of vacuum tubes or of hybrid solutions combining the two.

The transmitter may also comprise an inverter. The generator 101 may also incorporate an impedance adapter unit which adapts the output from the transmitter to the load in order to maximise the transfer of power to the medium. The generator output is connected to the well head by means of a coaxial cable 101*a*.

The wellhead perforator 103 is the part of the system that enables the signal to be transmitted from the surface to the inside of the well by way of a construction integrated in the equipment at the well head. The two ends of the perforator 103 are connected to the coaxial cable 101*a* coming from the generator and the coaxial cable 105 installed inside the well for the transmission of power to the base of the well.

In an embodiment of the invention, the wellhead perforator 103 is coaxial in construction. In another embodiment, the perforator 103 has a two-wire construction.

Any electrical construction which gives limited insertion loss and return loss values may be used to form the perforator 103.

The coaxial transmission line 105 at the base of the well is the construction allowing the signal to be transported to the base of the well, or to the antenna 100 input. Different types of construction may be used to form the coaxial cable 105.

The coaxial cable 105 must ensure characteristics that are appropriate for the distance over which power is to be transferred, in respect of both peak power and average power, and low attenuation of the signal, in order to be able to transfer the desired power to the base of the well continuously and to supply a high level of energy efficiency.

These characteristics improve as the diameter of the cable increases. To this end, the coaxial cable 105 must be dimensioned with sections of external conductor 105*a* (braid) and internal conductor 105*b* (core) large enough to transfer the power over the desired distance.

The characteristics of the coaxial cable 105 also depend on the dielectric material 106 separating the internal conductor 105*b* from the external one 105*a*. The use of materials with low dielectric losses enables the distance over which the cable can transfer power and the efficiency to be increased. Materials that can be used to form a cable suitable for the application are for example PTFE (polytetrafluoroethylene) and expanded PTFE, which have low losses. Other types of dielectric materials may also advantageously be used to form the coaxial cable 105.

The antenna 100 of the coaxial array of mode converters 107 has a length compatible with that of the drain, or with a relevant proportion of the drain (e.g. 30%, 50% or 70%). The length of the antenna 100 thus depends on the length of the drain and may thus vary with the type of well and reservoir. For horizontal wells, a typical drain length may be 1000 m. Substantial lengths of bore hole may also be found in vertical or slant wells that intersect very thick reservoirs (for example drain lengths of 100 m).

In such contexts, the antenna 100 of the array of mode converters 107 may be designed and used to heat the reservoir over the entire extent of the drain of the vertical or slant well.

The mode converters 107 are electrical constructions which are connected to one another along the coaxial cable 105. The particular construction of the mode converters 107 has the function of disturbing the differential mode of propagation of the RF signal along the cable 105. Disturbance of the propagation mode sets up a common mode. This produces currents that flow outside the coaxial cable 105 in a coaxial section that is centred on the point where the mode converter is installed. An emf is associated with such external currents in the surrounding area, and this heats the geological formation. This mechanism transfers a proportion of the power transported along the coaxial cable to the outside.

The use of an array of mode converters 107 positioned along the coaxial line 105 allows a considerable proportion or all of the power supplied to the coaxial cable 105 to be transferred.

Figure 2:
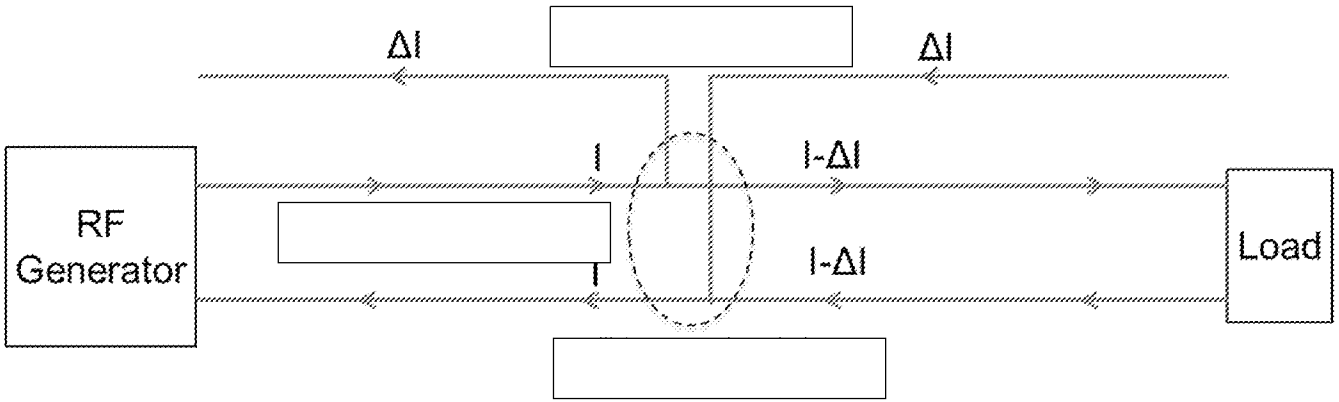
FIG. 2 shows the mechanism of electromagnetic mode conversion according to a preferred embodiment of the present invention.

FIG. 2 shows an illustration of the mechanism for converting the electromagnetic mode, which is the operating principle underlying the antenna. The figure shows how the discontinuity in the transmission line (resulting from the presence of the mode converter) changes the distribution of currents along the line itself and produces common-mode currents outside the line.

An array of interconnected mode converters 107 on the coaxial line 105 forms the antenna 100 installed in the section of drain.

The mode converters 107 have at least two conductors. The first conductor connects the braid of the coaxial section upstream of the line to the braid of the coaxial section downstream of the line. The second conductor connects the core of the coaxial section upstream of the line to the core of the coaxial section downstream of the line.

Favourably, the geometry of the conductors in the mode converters 107 is selected in order to create inductive and/or capacitive elements. Elements of this kind disturb the differential mode of propagation of the signal along the coaxial cable and allow a common mode to be set up. The latter induces currents in the external braid 105*a* of the coaxial cable 105 and an electromagnetic field in the surrounding area.

The electromagnetic field, of frequency f, heats the surrounding medium by means of inductive or dielectric heating mechanisms or a combination of the two.

In an embodiment of the invention, the currents that flow in the external braid 105*a* induce a magnetic field in the surrounding area and in particular inside the reservoir. Variation in the magnetic field over time in turn induces an electrical field inside the reservoir, which produces eddy currents of $J=sE$, where J is the current density, s is the electrical conductivity of the reservoir and E is the induced electrical current. The power dissipated per unit of volume inside the geological medium is $q=0.5\ s\ E^2$. This procedure forms the basis for the RF heating by an antenna installed in the well.

The mode converters 107 are elements connected to the coaxial cable 105 on both sides by means of appropriate connectors, which may be coaxial or two-wire in type.

The mode converters 107 may be of the inductive type. Inductance may be brought about by the geometric structure of one of the two conductors or both the conductors. Inductance may be brought about by combining the geometric structure of the conductors with the use of materials of high magnetic susceptibility.

The mode converters 107 may be of the capacitive type. Capacitance may be brought about by the geometric structure of one of the two conductors or both the conductors. Capacitance may be brought about by combining the geometric structure of the conductors with the use of materials of high dielectric permittivity.

Figure 3:
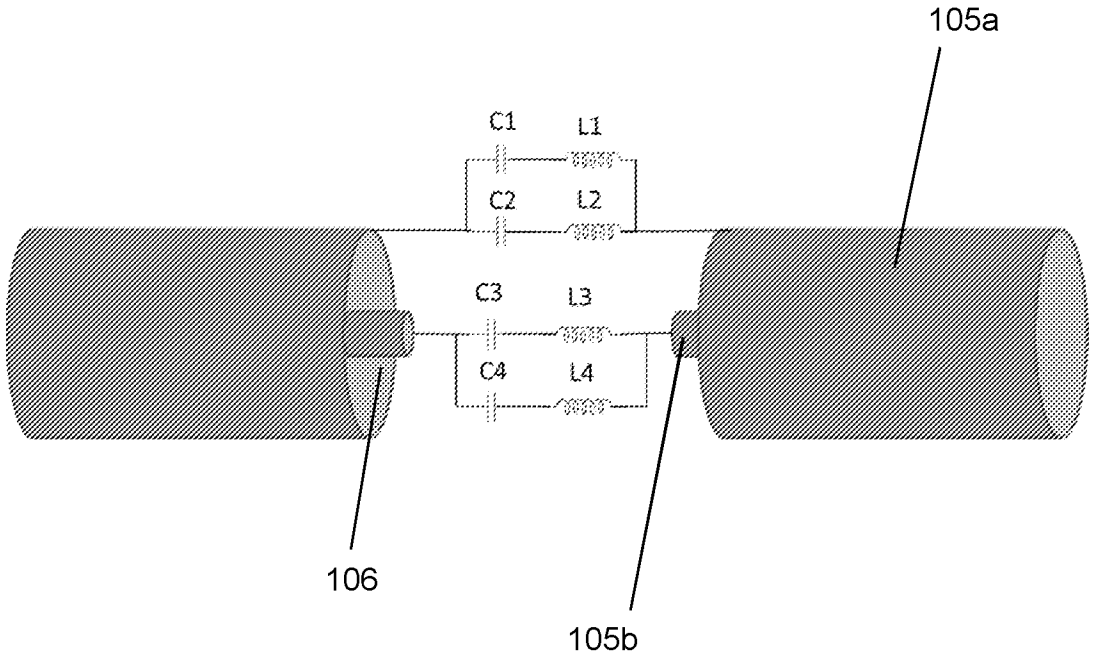
FIG. 3 shows a mode converter according to an embodiment of the present invention.

The mode converters 107 may be of the inductive-capacitive type. Mode converters of this kind are characterised by combinations of the constructions described above. FIG. 3 shows the general electrical layouts relating to the mode converters 107. The figure shows that various combinations of inductive and capacitive elements are possible. Either of the two conductors comprising the mode converter (internal and external) may include one or more inductive elements and/or one or more capacitive elements connected in series and/or in parallel. Another possibility is for the internal conductor or the external conductor to form a direct connection.

Figure 4:
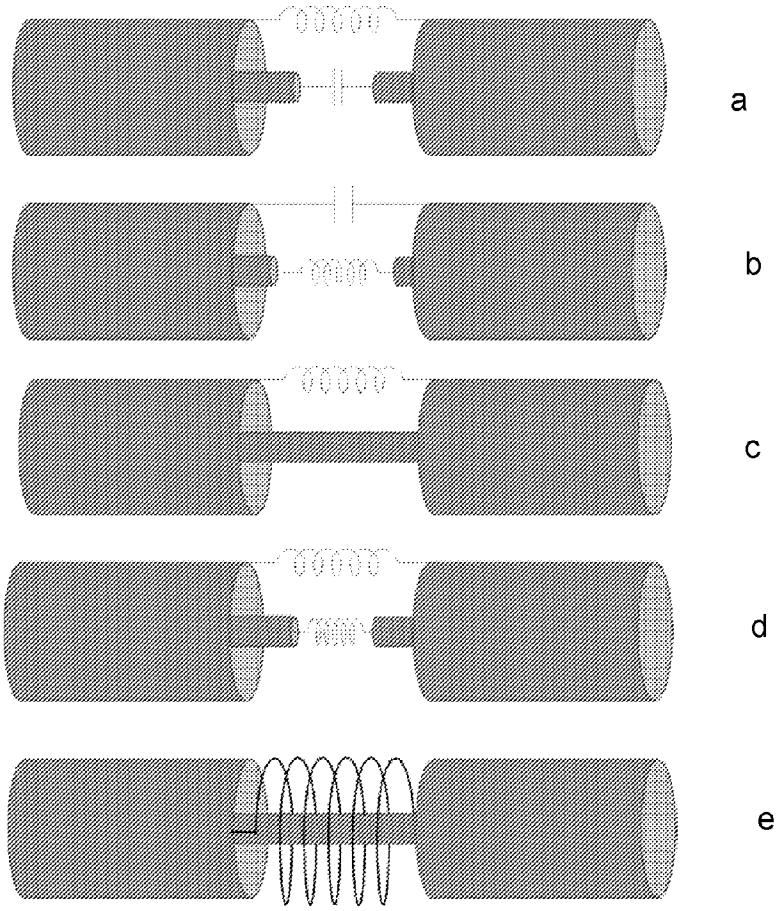
FIG. 4 shows some alternative embodiments of a mode converter.

FIG. 4 shows specific embodiments of inductive, capacitive and inductive-capacitive mode converters. In particular, FIG. 4*a* shows a mode converter 107 of the inductive-capacitive type in which the external conductor 105*a* is wound to form a coil structure which creates an inductance parameter, and in which the internal conductor 105*b* is interrupted by a pair of plates which create a capacitance parameter; FIG. 4*b* shows a mode converter 107 of the inductive-capacitive type in which the external conductor 105*a* is interrupted by a pair of plates which create a capacitance parameter, and the internal conductor 105*b* is wound to form a coil structure which creates an inductance parameter. FIG. 4*c*, by contrast, shows a mode converter 107 of the inductive type in which the external conductor 105*a* is wound to form a coil structure which creates an inductance parameter, and the internal conductor 105*b* forms a direct link from the core of the coaxial cable upstream to the core of the coaxial cable downstream. FIG. 4*d*, by contrast, shows a mode converter 107 of the inductive type in which the external conductor 105*a* is wound to form a coil structure which creates an inductance parameter, and the internal conductor 105*b*, like the external one, is also wound to form a coil structure which creates an inductance parameter; finally, FIG. 4*e* shows a mode converter 107 of the inductive type in which the external conductor 105*a* is wound to form a coil that is coaxial in relation to the internal conductor 105*b*, unlike the structures above, in which coils are positioned laterally in relation to the internal conductor.

Positioning a mode converter 107 on the coaxial line produces a discontinuity on the transmission line which causes a proportion of the power to be irradiated within the medium surrounding the antenna. The electromagnetic behaviour of a mode converter 107 may be described by way of two fundamental parameters: the efficiency of radiation (proportion of power irradiated in relation to the power input to the mode converter) and the return loss (proportion of power reflected in relation to the power input).

The values of such parameters in a specific mode converter depend on various variables, in particular the values of inductance and/or capacitance brought about by a mode converter, the frequency and the electromagnetic characteristics (dielectric permittivity and electrical conductivity) of the reservoir, the electromagnetic characteristics of the fluids inside the well, and any antenna coverings. It follows that the design of the array and the mode converters 107 or rather the selection of the distance between mode converters along the coaxial array 105, the constructional type of converter and the relative values of inductance and/or capacitance as a function of the frequency range and the electromagnetic characteristics of the surrounding medium, is one of the major aspects in constructing the system to which the present invention relates.

In particular, the mode converters 107 used to form an array generally have constructional characteristics that differ from one another. The mode converters 107 positioned at the beginning of the array must be designed to supply low radiation efficiency, that is to say to irradiate a limited proportion of the power that is input, and allow a substantial proportion of the power to be transmitted downstream.

The mode converters 107 positioned at the end of the array, by contrast, must supply a high radiation efficiency to irradiate a substantial proportion of the remaining power.

The end of the antenna 100 (corresponding to the base of the well) may be formed in various ways. It may be a short circuit or an open circuit to return the remaining, non-irradiated power from the mode converters and to allow it to be irradiated as it returns along the antenna 100, or an antenna of the resonant type, such as a coaxial monopole to irradiate the remaining non-irradiated power from the array of mode converters.

Figure 5:
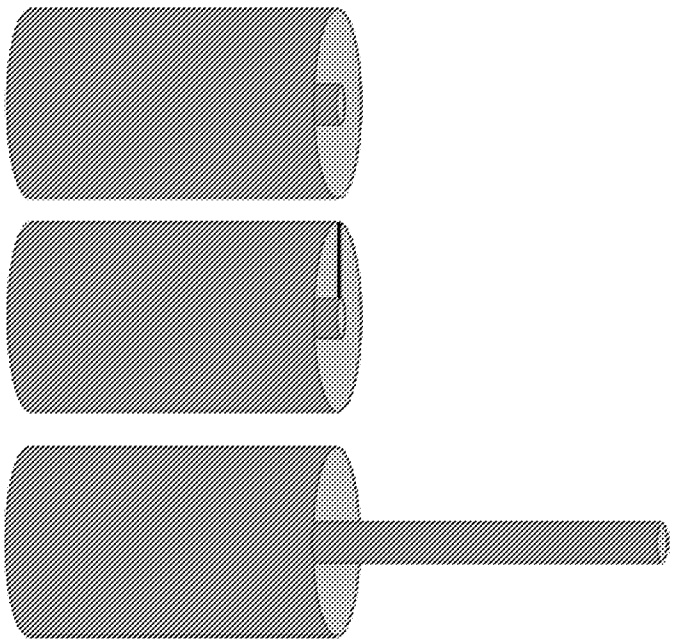
FIG. 5 shows possible embodiments for the end of the antenna that may be used in the system according to the present invention.

FIG. 5 shows possible embodiments of the antenna end, in particular an open circuit, a short circuit and an antenna of the monopole type produced from the coaxial cable.

The well may be an open bore hole within the reservoir, or it may advantageously be lined with a tube of non-conductive material (material such as glass fibre, PTFE or other thermoplastic materials, ceramics or systems of non-conductive materials of another type) to allow irradiation from the antenna installed within it.

The system to which the present invention relates may advantageously be formed by adapting the antenna 100 to reservoirs having different properties or heterogeneous properties along the drain by the selection of the electrical parameters and the positioning of each mode converter along the array.

In one aspect of the present invention, the individual mode converters may be designed to control the profile of irradiation along the drain.

For example, digital simulations carried out on electromagnetic antenna modelling instruments show that, by establishing inductance values in the range from a few tenths to a few tens of millihenrys, it is possible to obtain a range of radiation efficiencies to result in homogeneous heating over a drain 1000 m long. For example, in a resistivity range within the reservoir of 50-200 ohm meters (a resistivity range which is typical of geological formations composed of rock matrices in which there is a high saturation of hydrocarbons and limited water saturation), it is possible to achieve a range of radiation efficiencies of between 1% and 3% (which is required for the construction of an array of 100 elements and a total antenna length of 1000 m) with a frequency of 1 MHz using mode converters of the inductive type (with a coil connecting the braid sections of the coaxial cable) that are characterised by inductance values of between approximately 0.5 mH and 10 mH. Such inductance values may be obtained by forming coils of a diameter that is compatible with the installation in the well and having a number of turns of between 8 and 32. Mode converters of this type may have a length in the order of 40-60 cm.

Moreover, with inductance values of this kind, little power is returned from each mode converter (for the first converters in the array, with efficiencies in the order of 1%, the return loss is around −24 dB, and for converters at the end of the array, with efficiencies in the order of 30% or more, the return loss is −10 dB) and this allows a target in the order of −15 dB of total return loss for the antenna to be achieved, a value which is sufficient for the application (equivalent to a transfer of power to the formation of 97% and of power returned towards the generator of 3%).

This exemplary embodiment shows the possibility of achieving distributed RF heating that gives high levels of performance. Moreover, electrical preconditions of this kind enable mode converters to be constructed whereof the section of the construction is limited to values compatible with their installation in drains of production wells.

Purely by way of example, a diameter of 6 cm (equivalent to 2.4 inches) may be compatible with installation in the production well. This is because a production well could have a bore hole diameter of 8.5 inches and a liner having an internal diameter in the order of 5 inches. Thus, the exemplary embodiment allows the antenna to be installed in the well while leaving space for a possible antenna covering and for the flow of oil to the surface.

Installation of the RF system in the production well allows the effectiveness of thermal stimulation to be maximised while concentrating the heat close to the productive well and reducing the number of wells which have to be perforated in the production field.

In another aspect of the present invention, it is possible to minimise the ohmic losses along the drain by utilising the coaxial transport line (most efficient transmission line in the range of frequencies concerned) in the antenna section as well. This may be achieved by using a low-attenuation coaxial cable to form the array of mode converters, such as the coaxial cable used for the RF connection between the surface and the antenna input. Measurements of reflection over a range of frequencies may be carried out on the RF line installed in the well by connecting the line to a spectrum analyser. Reflection measurements at the surface are dependent on the return of the corresponding signal from each mode converter. The information obtained from reflectometry may thus be utilised to monitor the radiation characteristics of the antenna and the surrounding medium and to optimise the operating frequency.

The system to which the present invention relates may advantageously be applied to the thermal recovery of an individual well or of separate wells (heater and producer) and may be combined with other advanced recovery methods (IOR/EOR, improved oil recovery/enhanced oil recovery).

The invention claimed is:

1. System for heating highly viscous hydrocarbons in a reservoir comprising at least one drain of a well, the system being characterized in that it comprises:

a radio-frequency generator adapted to generate an RF electromagnetic signal;

a coaxial transmission line, connected to said generator and adapted to transmit the RF electromagnetic signal along said drain, said coaxial transmission line comprising an outer conductor and an inner conductor separated by a layer of dielectric material;

at least one mode converter positioned along said coaxial transmission line inside the well, in which said at least one mode converter interrupts said coaxial transmission line and comprises a first and a second conductor, said first conductor forming an electrical connection between an upstream location of said outer conductor of said coaxial transmission line upstream of said mode converter and a downstream location of said outer conductor of said coaxial transmission line downstream of said mode converter, said second conductor forming an electrical connection between an upstream location of said inner conductor of said coaxial transmission line upstream of said mode converter and a downstream location of said inner conductor of said coaxial transmission line downstream of said mode converter;

said at least one mode converter being arranged, in the presence of the RF electromagnetic signal along said coaxial transmission line to disturb a differential mode of signal propagation along said coaxial transmission line and to induce a current on said outer conductor of said coaxial transmission line and an electromagnetic field in the surrounding space that causes the heating of the highly viscous hydrocarbons within said reservoir.

2. The system according to claim 1 comprising a plurality of said mode converters distributed along said coaxial transmission line inside said well, in which said plurality of mode converters interrupts said coaxial transmission line.

3. The system according to claim 2, wherein said plurality of mode converters comprises an array of said mode converters arranged at regular intervals along said coaxial transmission line.

4. The system according to claim 2, wherein at least one of said plurality of mode converters is an inductive type, in which the perturbation of the differential mode of signal propagation along said coaxial transmission line is caused by at least one inductive element.

5. The system according to claim 2, wherein at least one of said plurality of mode converters is of capacitive type, in which the perturbation of the differential mode signal propagation along said coaxial transmission line is caused by at least one capacitive element.

6. The system according to claim 2, wherein at least one of said plurality of mode converters is capacitive and inductive, wherein the perturbation of the differential mode of signal propagation along said coaxial transmission line is caused by at least one capacitive element and by at least one inductive element.

7. The system according to claim 1, wherein the RF electromagnetic signal generated by said radio-frequency (RF) generator has a frequency between 0.1 and 10 MHz.

8. The system according to claim 7, wherein the RF electromagnetic signal has a frequency of between 0.5 and 5 MHz.

9. The system according to claim 3 in which said plurality of mode converters have dimensions and are positioned along said array in order to obtain a distributed/controlled radiation along said array itself.

10. A method for the extraction of hydrocarbons comprising the step of heating the hydrocarbons within said reservoir and said drain through the system according to claim 1.

11. A system for heating highly viscous hydrocarbons in a reservoir including at least one drain of a well, the system comprising:

a radio-frequency generator adapted to generate an RF electromagnetic signal;

a coaxial transmission line, connected to said generator and adapted to transmit the RF electromagnetic signal along the drain, said coaxial transmission line comprising an outer conductor and an inner conductor separated by a layer of dielectric material;

at least one mode converter positioned along said coaxial transmission line inside the well, in which said at least one mode converter interrupts said coaxial transmission line and comprises a first and a second conductor, said first conductor forming an electrical connection between an upstream location of said outer conductor of said coaxial transmission line upstream of said mode converter and a downstream location of said outer conductor of said coaxial transmission line downstream of said mode converter, said second conductor forming an electrical connection between an upstream location of said inner conductor of said coaxial transmission line upstream of said mode converter and a downstream location of said inner conductor of said coaxial transmission line downstream of said mode converter;

wherein said at least one mode converter comprises at least one of a capacitive element and an inductive element;

wherein said at least one mode converter is configured and arranged, in the presence of the RF electromagnetic signal along said coaxial transmission line, to disturb a differential mode of signal propagation along said coaxial transmission line and to induce a current on said outer conductor of said coaxial transmission line and an electromagnetic field in the surrounding space that causes the heating of the highly viscous hydrocarbons within said reservoir.

12. The system of claim 11 wherein said at least one capacitive element and said at least one inductive element are in series or parallel.

13. The system of claim 11 comprising at least one of the following: said first conductor forms an uninterrupted connection between the upstream location of said outer conductor and the downstream location of said outer conductor; and said second conductor forms an uninterrupted connection between the upstream location of said inner conductor and the downstream location of said inner conductor.

14. The system of claim 11 wherein said at least one mode converter comprises at least one of said mode converter of capacitive type and said mode converter of inductive type.

15. The system of claim 11 wherein at least one of said first conductor and said second conductor includes a first path including said capacitive element and said inductive element and a second path including said capacitive element and said inductive element, said capacitive element and said inductive element of said first path being in parallel with said capacitive element and said inductive element of said second path.

16. The system of claim 11 wherein said first conductor is wound to form a coil structure which creates said inductive element and said second conductor is interrupted by a pair of plates which create said capacitive element.

17. The system of claim 11 wherein said first conductor is interrupted by a pair of plates which creates said capacitive element, and said second conductor is wound to form a coil structure which creates said inductive element.

18. The system of claim 11 wherein said first conductor is wound to form a coil structure which creates said inductive element and said second conductor forms a direct link from the upstream location of said inner conductor to the downstream location of said inner conductor.

19. The system of claim 11 wherein said first conductor is wound to form a coil structure which creates said inductive element and said second conductor is wound to form a coil structure which creates said inductive element.

20. The system of claim 11 wherein said first conductor is wound to form a coil that forms said inductive element which is coaxial in relation to said second conductor that forms a direct link from the upstream location of said inner conductor to the downstream location of said inner conductor.

* * * * *